US006052867A

United States Patent [19]

Haab et al.

[11] Patent Number: 6,052,867

[45] Date of Patent: Apr. 25, 2000

[54] DEVICE FOR CONNECTING A DISPLACEABLE ELEMENT TO A GUIDE DEVICE

[75] Inventors: Karl Haab, Weggis; Otto Haab, Mettmenstetten, both of Switzerland

[73] Assignee: Hawa AG, Mettmenstetten, Switzerland

[21] Appl. No.: 09/147,713

[22] PCT Filed: Jun. 23, 1998

[86] PCT No.: PCT/CH98/00274

§ 371 Date: Feb. 23, 1999

§ 102(e) Date: Feb. 23, 1999

[87] PCT Pub. No.: WO98/59140

PCT Pub. Date: Dec. 30, 1998

[30] Foreign Application Priority Data

Jun. 24, 1997 [CH] Switzerland ..... 1533/97

[51] Int. Cl.[7] ..... E05D 15/00

[52] U.S. Cl. ..... 16/87.6 R; 16/87 R; 16/87.2; 16/99; 49/409; 160/196.1

[58] Field of Search ..... 16/87 R, 87.2, 16/95 D, 96 D, 87.6 R, 97, 98, 99; 49/425, 409; 160/196.1, 199, 206

[56] References Cited

U.S. PATENT DOCUMENTS

| | | | |
|---|---|---|---|
| 3,808,633 | 5/1974 | Lauterbach | 16/87 R |
| 3,925,933 | 12/1975 | Reuter | 49/409 |
| 4,991,257 | 2/1991 | Eutebach | 160/196.1 |
| 5,404,675 | 4/1995 | Schmidhauser | 49/409 |
| 5,450,693 | 9/1995 | Tarrega | 49/409 |

FOREIGN PATENT DOCUMENTS

| | | |
|---|---|---|
| 2151363 | 6/1994 | Canada . |
| 0305634 | 3/1989 | European Pat. Off. . |
| 0733766 | 9/1996 | European Pat. Off. . |
| 1242754 | 12/1959 | France . |
| 4242597 | 6/1994 | Germany . |

*Primary Examiner*—Chuck Y. Mah
*Attorney, Agent, or Firm*—Greenblum & Bernstein, P.L.C.

[57] ABSTRACT

Device for connecting a displaceable element, especially a glass, metal or wooden panel to a guiding device that is guided in a rail. The device includes first and second fixing members which each contain outer panels and fitting, elements which can be interconnected by an axle. The fitting elements are inserted into a cutout section on the edge of the displaceable element and interconnected. The fitting elements encompass a connection screw which can be connected to the guide device, the connection screw having a screw shaft with a screw head, a locking element and a thread. The fitting element of the first fixing member has a channel for receiving the screw shaft, the channel having channel walls, a trough for receiving the screw head and a cavity for receiving the securing element. The locking element can be stopped by a stop screw. The fitting element of the second fixing member has a recess for receiving the channel walls and an opening through which the screw head can be accessed. The assembled device can be adjusted by loosening the stop screws by a few turns and turning the connection screw until the displaceable element is set at the desired height. The stop screws are then re-tightened. The locking element is part of the connection screw and is encompassed in the device so that the top edge of the displaceable element can be drawn practically up to the rail.

14 Claims, 4 Drawing Sheets

DEVICE FOR CONNECTING A DISPLACEABLE ELEMENT TO A GUIDE DEVICE

BACKGROUND OF THE INVENTION

1. Field of the Invention

The present invention concerns a device for joining a sliding element, such as a glass, metal or wooden panel, with a guide device.

DISCUSSION OF BACKGROUND INFORMATION

To close room openings, sliding doors are often used that are suspended from a carriage that is guided on a track. For this purpose, a device is provided that is attached to the sliding door and connected to the carriage via a connecting bolt. From EP 0 733 766 A2, such a device is known that consists of a mounting piece that is screwed to a sliding wooden door and is intended for the accommodation of a connecting bolt that is screwed into the carriage. The head of the connecting bolt, which is mounted to rotate in the opened mounting piece, can be fixed in place by means of a safety cover, by which the mounting piece is closed. By opening the safety cover, the connecting bolt of the mounting piece (and the sliding door) can be loosened or tightened, so that the height of the sliding door can be adjusted.

For sliding glass elements which are suspended from a carriage guided on a track, generally, two mounting pieces are required that enclose a glass element and are screwed to one another in such a way that at least one bolt equipped with a thread is guided through an opening in the glass element, whereby said element is held by positive attachment to the bolt. By screwing together the two mounting pieces, which are drawn against the glass element located between them, a frictional attachment is generally also produced. Between the mounting pieces, for example, in a U-shaped cutout in the glass element, a screw that can be connected with a carriage is mounted to rotate, by means of which the height of the glass element can be adjusted. In order to lock the connecting bolt in position, a lock nut is planned which is provided above the mounting pieces and thus above the glass element. In the event that a lock nut is to be provided at the location shown, a relatively large distance must be selected between the track and the glass element and the mounting pieces. Moreover, the protrusion of fasteners is also undesirable for aesthetic reasons or for safety reasons.

In principle, a safety cover could be provided, by which means the connecting bolt may be locked, as in the device in EP 0 733 766 A2, which is not intended for glass elements. However, doing so would result in increased expense in the manufacture and installation of the device.

SUMMARY OF THE INVENTION

Therefore, the task that forms the basis of the present invention is to create a device that can be manufactured, installed, and adjusted at low cost, by means of which a sliding element, especially a glass element, can be joined via an adjustable and lockable connecting bolt to a carriage that is guided on a track.

This task is achieved through the present invention.

In accordance with the invention, the device—which includes two mounting pieces, preferably cast, a connecting bolt, several assembly screws, and, if necessary, two covers—can be manufactured at low cost. The connecting bolt is kept between the two mounting pieces and locked by preferably two screws that are provided between the mounting pieces and that need only be loosened a few turns for the adjustment of the connecting bolt. The space between the glass element or the mounting pieces and the guide track can thus amount to merely a few millimeters so that no trim piece is required. In addition, the required assembly screws and locking screws are preferably only accessible from one side of the device in accordance with the invention so that the other side of the device in accordance with the invention, advantageously facing outward, offers no access for (undesired) manipulations.

BRIEF DESCRIPTION OF THE DRAWINGS

The invention is described in further detail below with the aid of the drawings by way of example. Shown thereby are.

DETAILED DESCRIPTION OF THE PRESENT INVENTION

Figure 1:
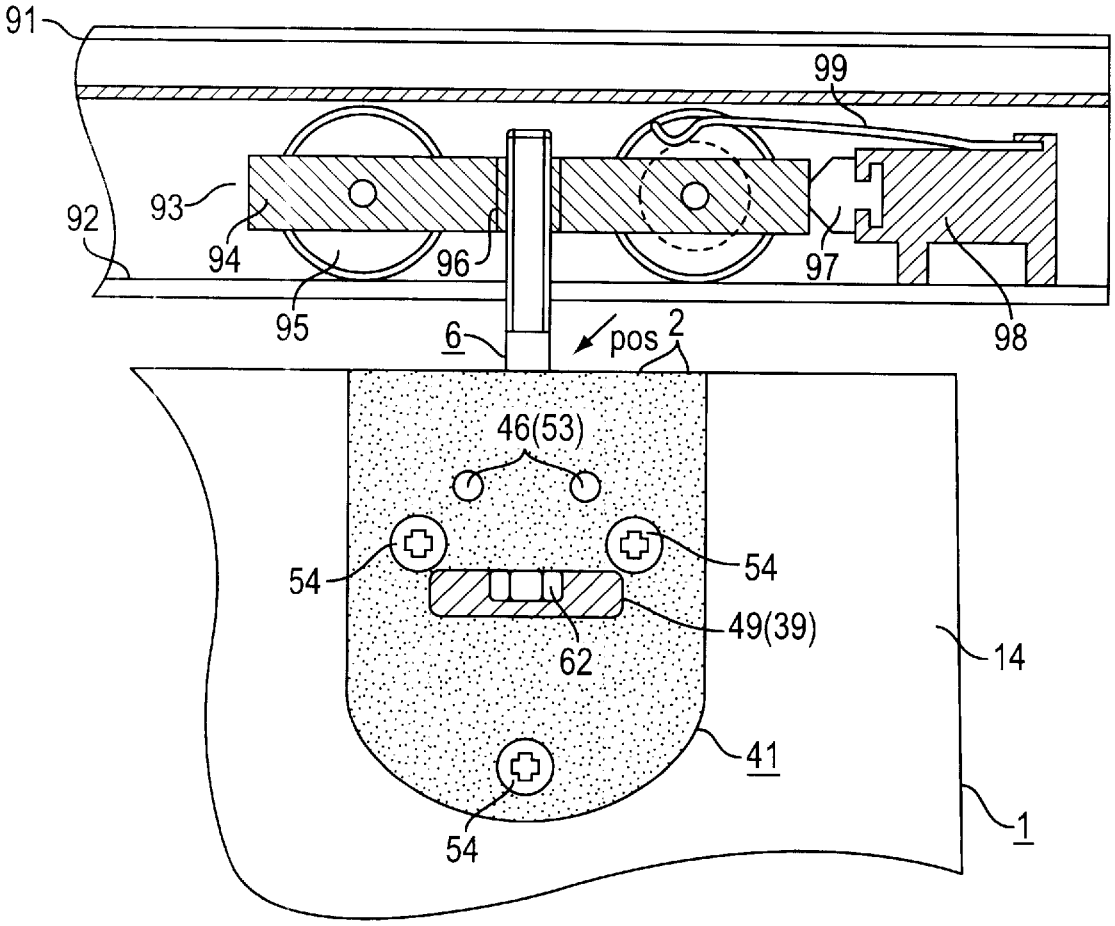
FIG. 1 a device 2 in accordance with the invention joined to a glass element 1 and a carriage 93, which has; two mounting pieces 31, 41 joined together and a connecting bolt 6.
Figure 7:
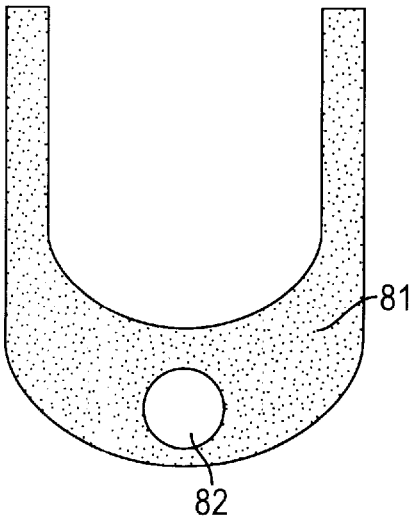
FIG. 7 an elastic liner 81.

FIG. 1 shows a device 2 in accordance with the invention that is joined on one side with a glass element 1 and on the other side, via a connecting bolt 6 with a carriage 93 that is guided in a track 91 and that has a carriage body 94 and two wheels 95 that roll along a running surface 92 of the guide track 91. The connecting bolt 6, through which the distance between the glass element 1 and the guide track 91 may be adjusted, is screwed into a thread 96 provided in the carriage body 94. Also provided in the guide track 91 is a bracket 98 with a bumper 97 that serves the cushioning of the carriage. The bracket 98 carries a spring element 99 that holds the carriage 93 in place as soon as this touches with the bumper 97.

Such carriages and associated tracks are known in the art, for example, from EP 0 733 766 A2 or EP 0 305 634 A1. However, implementation of the solution in accordance with the invention is also possible with other carriages known in the art.

Figure 2:
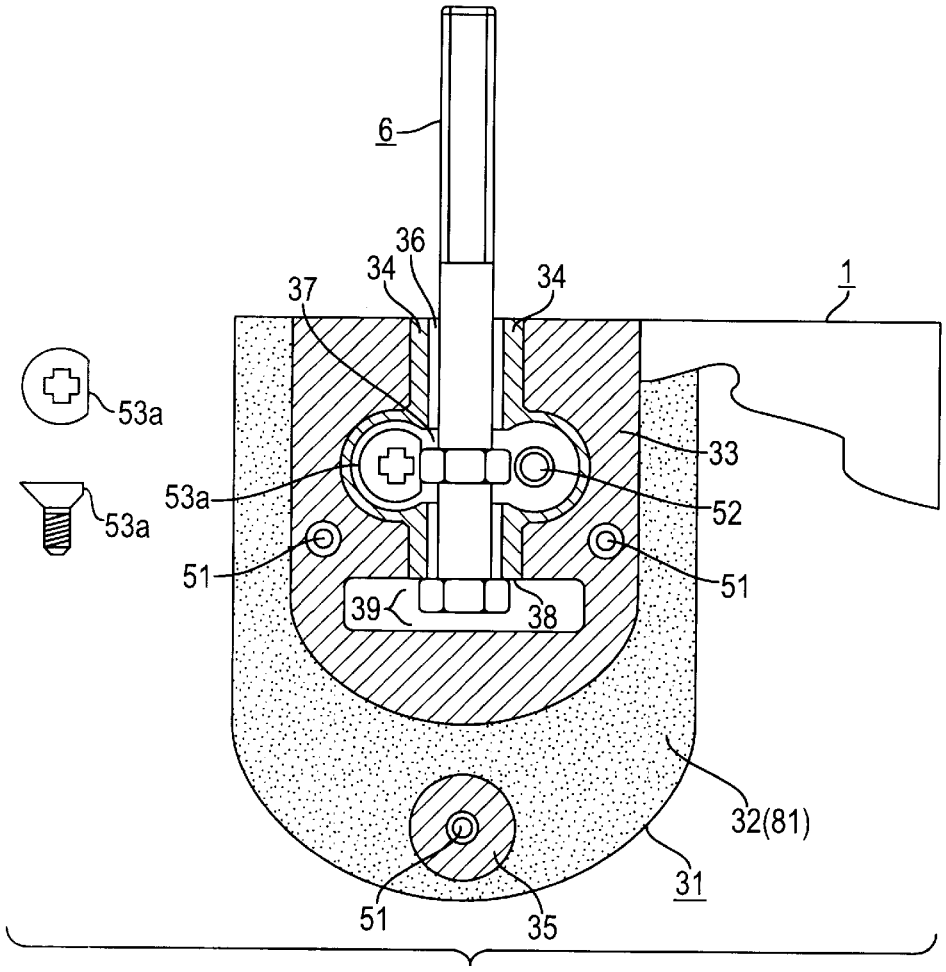
FIG. 2 a rear mounting piece 31 with the partially locked connecting bolt 6.
Figure 3:
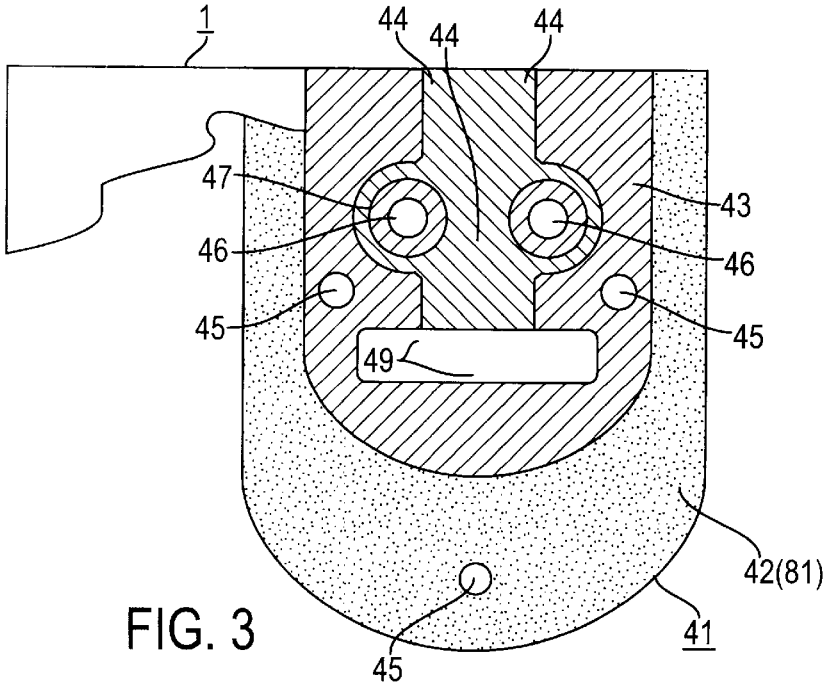
FIG. 3 a front mounting piece 41.

In an advantageous embodiment, the device 2 in accordance with the invention includes a rear mounting piece 31 shown in FIG. 2 and a front mounting piece 41 shown in FIG. 3, three assembly screws 54 and two locking screws 53 (see FIG. 4) or 53*a* (see FIG. 2) intended for locking the connecting bolt 6 that advantageously exhibits a tapered screw head. The locking screw 53*a* shown in FIG. 2 has a screw held that is cut in such a way that the connecting bolt 6 is exposed once with each rotation of the locking screws 53*a*. As a result, the element 1 equipped with the rear mounting piece 31 can be installed more easily. For this purpose, the connecting bolt 6 is screwed into the thread 96 provided in the carriage body 94. In addition, the two locking screws 53*a* are turned far enough until the cut surfaces of the screw heads face one another and the recess 37 is exposed for the accommodation of the locking element 61. Then the rear mounting piece 31 can be suspended from the connecting bolt 6 without removing the locking screws. In the same way, the connection between the connecting bolt 6 and the mounting piece 31 can be released again.

Shown in FIG. 1 is the front mounting piece (or member) 41, which is joined by the assembly screws 54 to the rear mounting piece (or member) 31. The head 62 of the connecting bolt 6 enclosed by the mounting pieces 31, 41 is accessible through an opening 49. The locking screws 53 (see FIG. 2) are accessible through bore holes 46 so that the adjustment of the installed device 2 can occur with few manipulations and without the temporary removal of parts of the device. A screwdriver or wrench may be inserted in the bore holes 46, after which the locking screws 53 and thus the connecting bolt 6 may be loosened. Then a wrench may be inserted into the opening 49, after which the connecting bolt 6 may be adjusted. Finally, the locking screws 53 may be tightened again.

Figure 5:
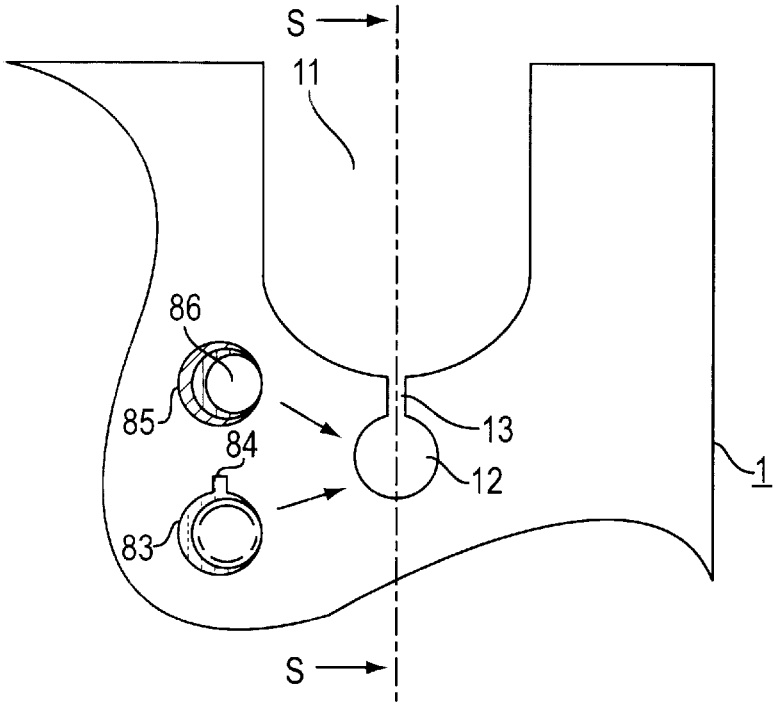
FIG. 5 a glass element 1 ready for installation of the device 2 in accordance with the invention.

The mounting pieces 31 and 41 are preferably designed in such a way that the rear mounting piece 31 provides for the accommodation of the connecting bolt 6 as well as the transport of the glass element 1, which, as shown in FIG. 5, exhibits a bore hole 12 provided for the accommodation of a supporting axle 35 and a cutout 11 for the accommodation of the interlocking mounting pieces 31, 41. A slot 13 is advantageously provided between the bore hole 12 and the cutout 11 to relieve stresses. The rear mounting piece 31 shown in FIG. 2 thus exhibits an outer plate 32 on which the axle 35 to be inserted in the bore hole 12 and an insert 33 to be fitted into the cutout 11 are provided, which together exhibit three threaded holes 51 for the accommodation of the assembly screws 54.

Figure 8:
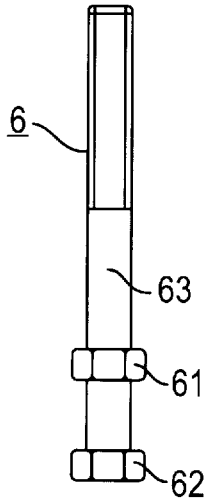
FIG. 8 the connecting bolt 6.

FIG. 8 shows the connecting bolt 6, which exhibits a bolt head 62 and a locking element 61, which for example takes the shape of a threaded nut provided on the bolt shaft 63. The insert 33 exhibits a channel 36 providing for the insertion of the bolt shaft 63) that is bounded by channel walls 34 which advantageously extend beyond the insert 33 by approximately one half the diameter of the bolt 6. The channel 36, is approximately half as deep as the diameter of the bolt 6, exhibits a recess 37 provided for the accommodation of a locking element 61. The bolt shaft 63 is thus accommodated practically completely by the channel 36 and the channel walls 34. Connecting to the channel 36, the insert 33 exhibits a trough 39 provided for the accommodation of the bolt head 62. Thereby, a collar 38, upon which the head 62 of the connecting bolt 6 is resting, is formed between the closed channel 36 and the channel walls 34. In the recess 37 on both sides of the locking element 61, threaded holes 52 are provided, into which the locking screws 53 or 53*a* can be screwed until the locking element 61 is locked. As already described, the locking screw 53*a* shown in FIG. 2 exhibits a screw head that is cut in such a way that the connecting bolt 6 or the locking element 61 attached to the connecting bolt 6 is exposed once with each rotation of the locking screws 53*a*.

The recess 37 provided in the insert 33 and the trough 39 are delimited below by the outer plate 32, which advantageously exhibits no openings (bore holes, etc.) and thus offers no access to other parts of the device 2 in accordance with the invention. The outer plate 32 of the rear mounting piece 31 is preferably provided on the outside 15 of the glass element 1, whereby undesired opening of the sliding glass door from the outside is prevented.

The rear mounting piece 31 is, as shown in FIG. 1, closed off by the front mounting piece 41 to be mounted on the inside of the glass element 1, which is described in greater detail with the aid of FIG. 3. The front mounting piece 41 likewise exhibits an outer plate 42 and an insert 43 to be fitted into the cutout 11 of the glass element 1, which are fitted with three bore holes 45 which serve the transport of the assembly screws 54. The insert 43 also exhibits a recess 44, for the accommodation of the channel walls 34, as well as an opening 49 guided through the outer plate 42 and which is located above the trough 39 and offers access to the head 62 of the connecting bolt 6. In the recess 44 two bore holes 46 are provided, though which a screwdriver can be directed up to the locking screws 53 or 53*a*. So that the locking screws 53 or 53*a* each can be loosened adequately, recesses 47 concentric to the bore holes 46 are provided, into which the heads of the locking screws 53 or 53*a* can be tuned. The size of the recess 44 is selected such that its upper surface closes the channel 36 or the channel walls 34 during the assembly of the mounting pieces 31, 41, whereby the shaft 63 of the connecting bolt 6 is held with only slight clearance and the collar 38 is completed. All assembly elements (screws 6, 53 and 54) of the device 2 in accordance with the invention are thus accessible only on the inside 14 of the glass element 1.

Advantageously provided between the glass element 1 and the two mounting pieces 31, 41 are elastic liners 81 (the opening 82 serves the passing of the axle 35), which prevents stresses from being transmitted by the assembled device 2 to the glass element 1.

During the manufacture of glass element 1, it is planned that the diameter of bore hole 19 be larger than the diameter of axle 35. So that the axle 35, which is provided to carry the glass element 1, is held tightly in the bore hole 12, either an eccentric 85 or preferably a peg 83 with a projection 84 is provided that is pressed into the opening 12 and the slot 13 and is subsequently fitted with a bore hole running concentrically to the axle 35. A rotation of the peg 83 is thereby hindered by the projection 84. As a pattern for the bore hole, the front mounting piece 41 can be used, for example.

Figure 6:
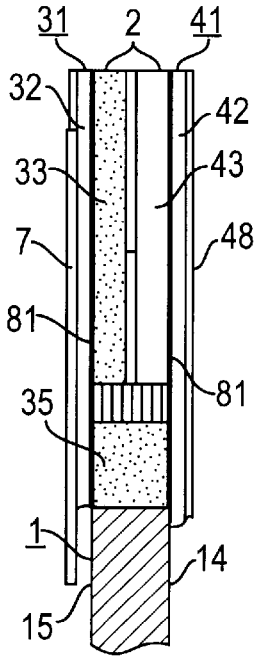
FIG. 6 a cross-sectional view of the glass element 1 from FIG. 5 with the device 2 in accordance with the invention in place.

In FIG. 6, a cross-section SS of the glass element 1 is shown with installed mounting pieces 31, 41. It can be seen hereby that the inserts 33, 43 extend into the cutout 11 and the outer plates 32, 42, are separated therefrom by the liners 81, and lie against the sides 15, 14 of the glass element 1. The outer plates 31, 41 are advantageously fitted with retaining grooves 48 into which the covers 7 can be slid.

Figure 9:
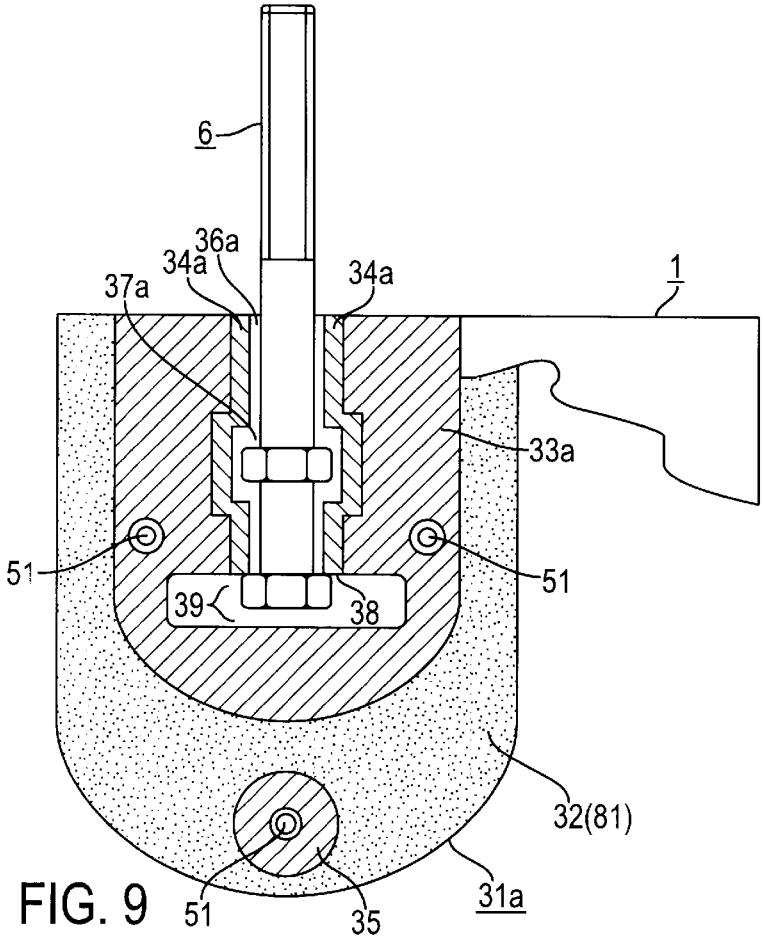
FIG. 9 a rear mounting piece 31*a* with the unlocked connecting bolt 6.
Figure 10:
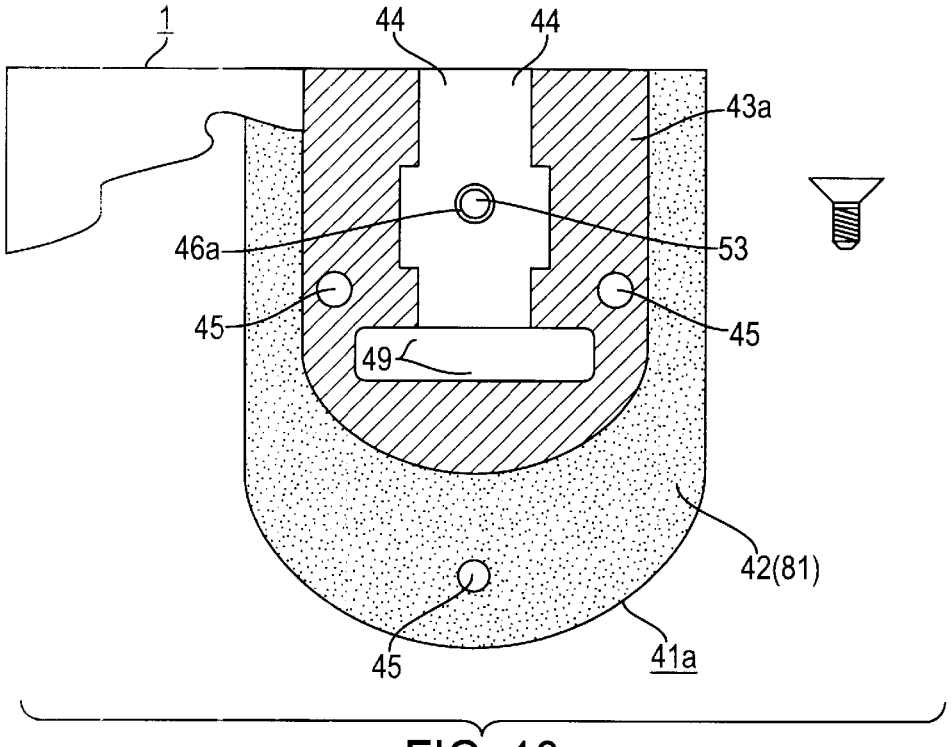
FIG. 10*a* front mounting piece 41*a* corresponding to the mounting piece 31*a* shown in FIG. 9, which has a threaded hole 46*a* for a locking screw 53.

The device 2 in accordance with the invention is thus of particular advantage because, among other things, the assembly screws and locking screws are accessible from one side only (normally from the inside of a locked room). For this reason, the axle 35 fitted with a threaded hole 51 is also placed on the rear mounting piece 31. Likewise, the design of the connecting bolt 6 and the placement of the channel 236, the channel walls 34 and the locking screws 53 are selected in a particularly advantageous manner. Additional designs of the device 2 in accordance with the invention are easily possible. For example, the number and arrangement of the assembly screws and locking screws 51, 54 or the design of the connecting element 6 or the locking element (lock nut) 61 can be changed as desired. In addition, the positions of the recess 37 and the trough 39 with the associated opening 49 could be exchanged, whereby the lock nut 61 and bolt head 62 exchange their functions. Further design possibilities also exist with regard to the arrangement of the locking screws 53. In FIG. 9 the insert 33*a* of a rear mounting piece 31*a* exhibits a channel 36*a* with channel walls 34*a*, which surround a recess 37*a* in which no threaded holes are provided for locking screws. A threaded hole 46*a* for a preferably countersinking locking screw 53 is provided in the outer plate 42*a* of the front mounting piece 41*a*, as shown in FIG. 10. Through the outer plate 43*a*, the locking screw 53 can be screwed into the recess 44*a* of the insert 43*a* until it contacts the locking element 61 and fixes it in place. The device shown in FIG. 9 and FIG. 10 is simple to manufacture. It is potentially of advantage, however, if the connecting bolt 6 can be fixed in place before the front mounting piece is installed.

The device 2 in accordance with the invention serves particularly the hanging of glass elements. Of course, however, the device 2 in accordance with the invention can be installed on panels of any desired type. The device 2 can also be used particularly advantageously for the hanging of thin metal or wooden panels. The use of an elastic liner 81 is preferably omitted thereby.

Figure 4:
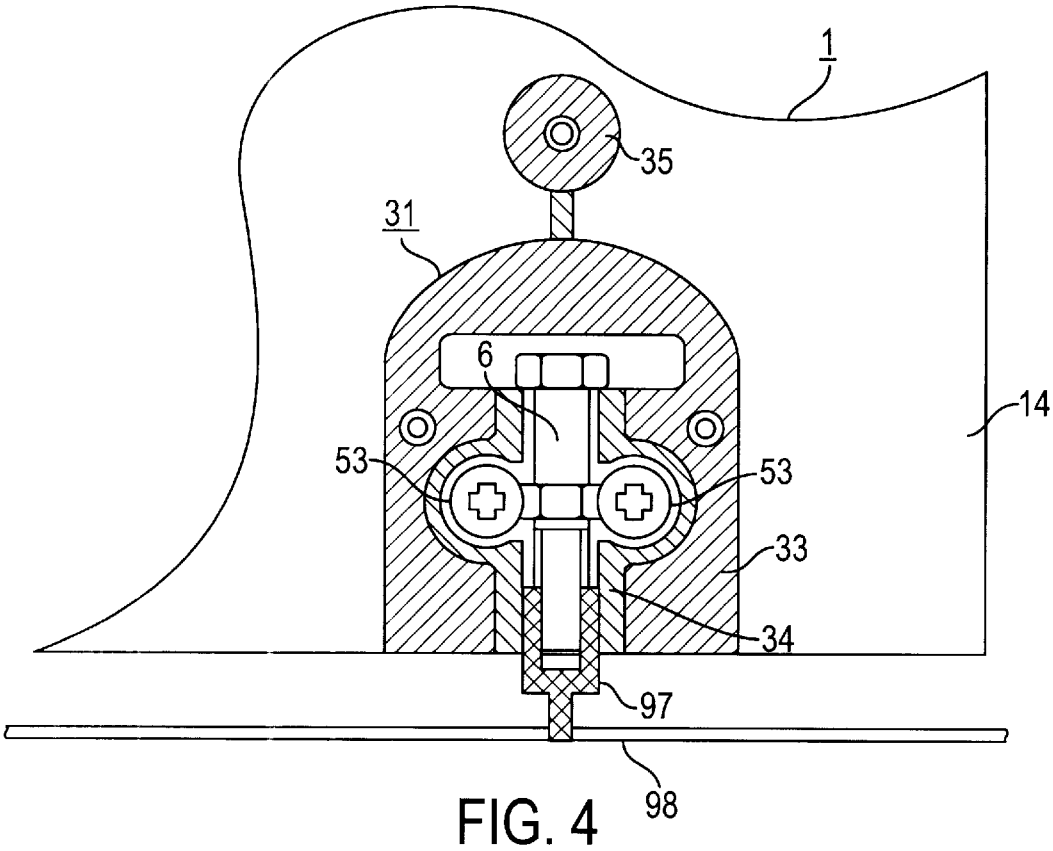
FIG. 4 the rear mounting piece 31 mounted on the underside of the glass element 1 with a guide piece 97 guided in a groove 98.

The device 2 in accordance with the invention is preferably used for the joining of a sliding element 1 with a carriage 93 that is guided in a track 91 provided above the element 1. However, FIG. 4 shows that the device 2 in accordance with the invention is also advantageously suited for the joining of the element 1 with a guide piece 97*a* that is guided in a bottom track or groove 98*a* provided on the ground. The guide piece 97*a* includes preferably of an internally threaded cylinder that is vertically displaceable in the channel 36 and into which the connecting bolt 6 is screwed. The cylinder preferably exhibits axially oriented comers that are guided along the channel walls 34 and thus that prevent rotation of the cylinder within the channel 36. By turning the connecting bolt 6, the guide piece 97*a* can therefore be lowered in the bottom guide track 98*a*.

What is claimed is:

1. A device for connecting a sliding element with a guide device, the guide device adapted to be guided in a track, the device comprising:

an axle;

a first mounting member having a first outer plate and a first insert;

a second mounting member having a second outer plate and a second insert, said first and second outer plates adapted to be joined by said axle, said first and second inserts adapted to be inserted into a cutout provided on an edge of the sliding element, said first and second inserts further adapted to be connected with one another;

a connecting bolt enclosed by and positioned intermediate said first and second inserts, and adapted to be connected to the guide device, said connecting bolt comprising a shaft having a head, a locking element and a thread;

wherein said first insert comprises:

a channel having channel walls adapted to accommodate said shaft therein;

a trough adapted to accommodate said head;

a first recess adapted to accommodate said locking element; and a locking screw adapted to lock said locking element; and wherein said second insert has an opening and comprises a second recess adapted to accommodate said channel walls therein, and wherein a radial center of said opening is substantially coaxial to a radial center of said head.

2. The device in accordance with claim 1, wherein said first recess has at least one threaded hole adapted to receive said locking screw, said recess being externally accessible through a bore provided in said second mounting member.

3. The device in accordance with claim 1, further comprising:

a screw;

wherein said second outer plate has a threaded hole adapted to receive said screw therein, said screw adapted to rotate in said threaded hole until said screw contacts said locking element.

4. The device in accordance with claim 3, wherein said screw is a countersinking locking screw.

5. The device in accordance with claim 1, wherein a depth of said channel and a height of said channel walls are approximately equal to the diameter of the shaft of said connecting bolt.

6. The device in accordance with claim 5, wherein:

said axle is adapted to be inserted through a hole provided in the sliding element, said axle located on said first outer plate, said axle having a threaded hole adapted to receive an assembly screw;

said second mounting member has a second mounting member hole; and said assembly screw is adapted to be inserted through said second mounting member hole into said threaded hole of said axle.

7. The device in accordance with claim 6, further comprising one of:

an eccentric adapted to be inserted into said sliding element hole and having an opening adapted to accommodate said axle therethrough; and a hole insert adapted to be inserted into said sliding element hole and having an axle hole adapted to accommodate said axle therethrough, said axle hole being concentric to said axle.

8. The device in accordance with claim 7, wherein said hole insert further comprises a projection adapted to be inserted into a slot provided in said locking element, said slot connecting said locking element hole and said cutout.

9. The device in accordance with claim 6, wherein:

said second mounting member has at least an additional second mounting member hole adapted to receive at least one assembly screw;

said first insert has at least one threaded hole; and said at least one assembly screw is adapted to be threadedly screwed into a respective said at least one threaded hole of said first insert.

10. The device in accordance with claim 1, wherein said first outer plate has no openings to provide external access to the contents of the device.

11. The device in accordance with claim 10, wherein said first outer plate is located on an outer surface of the sliding element.

12. The device in accordance with claim 1, wherein the device is installed on a top or on a bottom of the element, and is further adapted to be connected to one of a carriage and a guide piece guided in a track.

13. The device in accordance with claim 1, wherein said locking screw has a screw head that is configured such that said connecting bolt may be freely rotated in association with at least one rotational position of said locking screw.

14. The device in accordance with claim 1, wherein the sliding element is one of glass, metal, or wood.

* * * * *